US008382051B2

(12) United States Patent
Smith

(10) Patent No.: US 8,382,051 B2
(45) Date of Patent: Feb. 26, 2013

(54) WALL-MOUNTED SUPPORT ASSEMBLY FOR BATHROOM ACCESSORIES

(75) Inventor: Matthew S. Smith, Wooster, OH (US)

(73) Assignee: Waxman Consumer Products Group Inc., Bedford Heights, OH (US)

( * ) Notice: Subject to any disclaimer, the term of this patent is extended or adjusted under 35 U.S.C. 154(b) by 52 days.

(21) Appl. No.: 12/963,804

(22) Filed: Dec. 9, 2010

(65) Prior Publication Data

US 2012/0145854 A1 Jun. 14, 2012

(51) Int. Cl.
*A47B 96/00* (2006.01)

(52) U.S. Cl. ..... 248/221.11; 248/224.7; 248/251; 211/105.1

(58) Field of Classification Search ..... 248/221.11, 248/222.13, 310, 314, 315, 226.11, 220.21, 248/251, 201, 222.14, 254, 258, 261, 262, 248/264, 349.1, 346.03, 345, 224.7, 223.21, 248/225.11, 222.11, 222.41; 211/105.1, 211/123, 576.1; 4/576.1
See application file for complete search history.

(56) References Cited

U.S. PATENT DOCUMENTS

| | | | | |
|---|---|---|---|---|
| 2,712,950 | A * | 7/1955 | Siebert | 285/7 |
| 6,113,045 | A * | 9/2000 | Kuo | 248/222.14 |
| 6,334,597 | B1 * | 1/2002 | Ming-Hsiao | 248/305 |
| 6,817,044 | B1 * | 11/2004 | Ouyoung | 4/576.1 |
| 7,641,161 | B2 | 1/2010 | Bauer | |
| 7,926,772 | B2 * | 4/2011 | Lowe et al. | 248/222.14 |
| 7,967,522 | B2 * | 6/2011 | Goad | 403/292 |
| 2002/0104946 | A1 * | 8/2002 | Lai | 248/316.8 |
| 2004/0160775 | A1 * | 8/2004 | Goodlett et al. | 362/253 |
| 2004/0160776 | A1 * | 8/2004 | Fang et al. | 362/257 |
| 2005/0072874 | A1 * | 4/2005 | Denen et al. | 242/563 |
| 2005/0127232 | A1 * | 6/2005 | Moody et al. | 242/564.4 |
| 2005/0263655 | A1 * | 12/2005 | Bauer | 248/223.31 |
| 2006/0175496 | A1 * | 8/2006 | Lai | 248/251 |
| 2007/0029435 | A1 * | 2/2007 | Moody et al. | 242/559.2 |
| 2009/0242713 | A1 * | 10/2009 | Lowe et al. | 248/222.13 |

* cited by examiner

*Primary Examiner* — Terrell McKinnon
*Assistant Examiner* — Eret McNichols
(74) *Attorney, Agent, or Firm* — Tarolli, Sundheim, Covell & Tummino LLP

(57) ABSTRACT

A wall-mounted bathroom accessory support assembly for supporting a bathroom accessory and adapted to be affixed to a bathroom wallboard. The support assembly includes: a mounting bracket; a fastener assembly adapted to affix the mounting bracket to a wallboard; and an accessory post assembly including an accessory post and a post adapter permanently affixed to the accessory post. The accessory post includes a wall defining a central body and a distal portion configured to support a bathroom accessory. The accessory post wall defines an open interior region and an access opening extending through the wall. The post adapter is disposed within the interior region of the accessory post wall and including an axially extending pedestal that includes a cantilevered flange. The mounting bracket includes a catch mechanism. The post adapter cantilevered flange engages the catch mechanism to releasably secure the accessory post assembly to the mounting bracket.

21 Claims, 8 Drawing Sheets

WALL-MOUNTED SUPPORT ASSEMBLY FOR BATHROOM ACCESSORIES

TECHNICAL FIELD

The present invention relates to a wall-mounted support assembly and, more particularly, to a wall-mounted support assembly for supporting a variety of bathroom accessories such as towel bars, towel rings, soap dishes, shampoo racks, and the like, wherein the support assembly includes an accessory post assembly removably secured to a wall mounting bracket, the accessory post assembly including a cantilevered flange defining a latch for engaging a catch assembly of the mounting bracket.

BACKGROUND

Bathroom accessories such as towel bars, towel rings, soap dishes, and shampoo racks are typically attached to a bathroom wall with a support assembly that utilizes a mounting bracket attached to the wall with one or more fasteners. An accessory support has an end portion sized and shaped to receive and support a specific bathroom accessory. For example, the accessory support end portion may be sized and shaped to receive and support one end of a towel bar or may be sized and shaped to receive a towel ring or may be sized and shaped to receive a mounting projection of a soap dish. The accessory support is typically secured to the mounting bracket utilizing a set screw.

Because of the limited space in many bathrooms, installation of an accessory support is difficult. The small size, orientation, and location of the set screw adjacent the bathroom wall adds further difficulty to the installation process. The installer must manually screw the set screw into the mounting bracket utilizing a small screwdriver and having limited clearance from the bathroom wall. Additionally, the set screw is prone to being lost or dropped during installation. Finally, the set screw has fine threads and may be overtightened during installation. Overtightening the set screw can cause the mounting bracket threads to be stripped and compromise the integrity of the accessory support to the mounting bracket.

SUMMARY

One exemplary embodiment of the present disclosure includes a wall-mounted support assembly for supporting a bathroom accessory, the support assembly adapted to be affixed to a wallboard and extending along a central axis transverse to a surface of a wallboard when the support assembly is affixed to a wallboard. The wall-mounted support assembly comprises: a mounting bracket; a fastener assembly adapted to affix the mounting bracket to a wallboard; an accessory post assembly including an accessory post and a post adapter permanently affixed to the accessory post, the accessory post includes a wall defining a central body and a distal portion extending axially from an end of the central body, the distal portion configured to support a bathroom accessory, the accessory post wall defining an open interior region and an access opening extending through the wall, the post adapter disposed within the interior region of the accessory post wall and including an axially extending pedestal that includes a cantilevered flange disposed between a pair of axially extending slots, the cantilevered flange having a latch at a free end of the flange and an intermediate region spaced from the free end, the intermediate region being aligned with the accessory post wall access opening; and the mounting bracket including a radially extending annular rim for abutting a wallboard when the support assembly is mounted to a wallboard, the mounting bracket annular rim defining a catch mechanism including a latch opening and a boss protruding axially from the rim, the latch opening and boss of the catch mechanism adapted to allow the latch to pass through the latch opening and engage the boss to releasably secure the accessory post assembly to the mounting bracket.

Another exemplary embodiment of the present invention includes a wall-mounted support assembly for supporting a bathroom accessory. The support assembly is adapted to be affixed to a wallboard and the support assembly extending along a central axis transverse to a surface of a wallboard when the support assembly is affixed to a wallboard. The support assembly comprises: a mounting bracket; a fastener assembly adapted to affix the mounting bracket to a wallboard; an accessory post assembly including an accessory post and a post adapter permanently affixed to the accessory post, the accessory post includes a wall defining a central body and a distal portion extending axially from an end of the central body, the distal portion configured to support a bathroom accessory, the accessory post wall defining an open interior region and an access opening extending through the wall, the post adapter disposed within the interior region of the accessory post wall and including an axially extending pedestal that includes a cantilevered flange disposed between a pair of axially extending slots, the cantilevered flange having a latch at a free end of the flange and an intermediate region spaced from the free end, the intermediate region being aligned with the accessory post wall access opening; the mounting bracket including a radially extending annular rim for abutting a wallboard when the support assembly is mounted to a wallboard, the mounting bracket annular rim defining a catch mechanism including a latch opening and a boss protruding axially from the rim; to releasably attach the accessory post assembly to the mounting bracket, the accessory post assembly is axially aligned with the mounting bracket and is moved axially toward the mounting bracket such that the post adapter latch passes through the catch mechanism latch opening and engages the boss of the catch mechanism; and to detach the accessory post assembly from the mounting bracket, the intermediate region of the cantilevered flange is contacted through the accessory post access opening and deflected radially inwardly and the accessory post assembly is moved axially away from the mounting bracket such that the post adapter latch passes through the catch mechanism latch opening and disengages from the catch mechanism.

Another exemplary embodiment of the present disclosure includes a method of releasably attaching and detaching an accessory post assembly of a wall-mounted support assembly from a mounting bracket of the wall-mounted bathroom accessory support assembly wherein the mounting bracket is affixed to a wallboard. The steps of the method comprise: a) providing a wall-mounted support assembly including: the mounting bracket; a fastener assembly adapted to affix the mounting bracket to a wallboard; the accessory post assembly including an accessory post and a post adapter permanently affixed to the accessory post, the accessory post includes a wall defining a central body and a distal portion extending axially from an end of the central body, the distal portion configured to support a bathroom accessory, the accessory post wall defining an open interior region and an access opening extending through the wall, the post adapter disposed within the interior region of the accessory post wall and including an axially extending pedestal that includes a cantilevered flange disposed between a pair of axially extending slots, the cantilevered flange having a latch at a free end of the flange and an intermediate region spaced from the free end, the intermediate region being aligned with the accessory post wall access opening; and the mounting bracket including a radially extending annular rim for abutting a wallboard when the support assembly is mounted to a wallboard, the mounting bracket annular rim defining a catch mechanism including a latch opening and a boss protruding axially from the rim, the latch opening and boss of the catch mechanism adapted to allow the latch to pass through the latch opening and engage the boss to releasably secure the accessory post assembly to the mounting bracket; b) attaching the accessory post assembly to the mounting bracket by axially aligning the accessory post assembly with the mounting bracket and moving the accessory post assembly toward the mounting bracket such that the post adapter latch passes through the catch mechanism latch opening and engage the boss of the catch mechanism to attach the accessory post assembly to the mounting bracket; and c) detaching the accessory post assembly from the mounting bracket by contacting and deflecting radially inwardly the intermediate region of the cantilevered flange through the accessory post access opening and moving the accessory post assembly axially away from the mounting bracket such that the post adapter latch passes through the catch mechanism latch opening and disengages from the catch mechanism to detach the accessory post assembly from the mounting bracket.

BRIEF DESCRIPTION OF THE DRAWINGS

The foregoing and other features and advantages of the present invention will become apparent to one skilled in the art to which the present invention relates upon consideration of the following description of the invention with reference to the accompanying drawings, wherein like reference numerals refer to like parts unless described otherwise throughout the drawings and in which.

DETAILED DESCRIPTION

Figure 1:
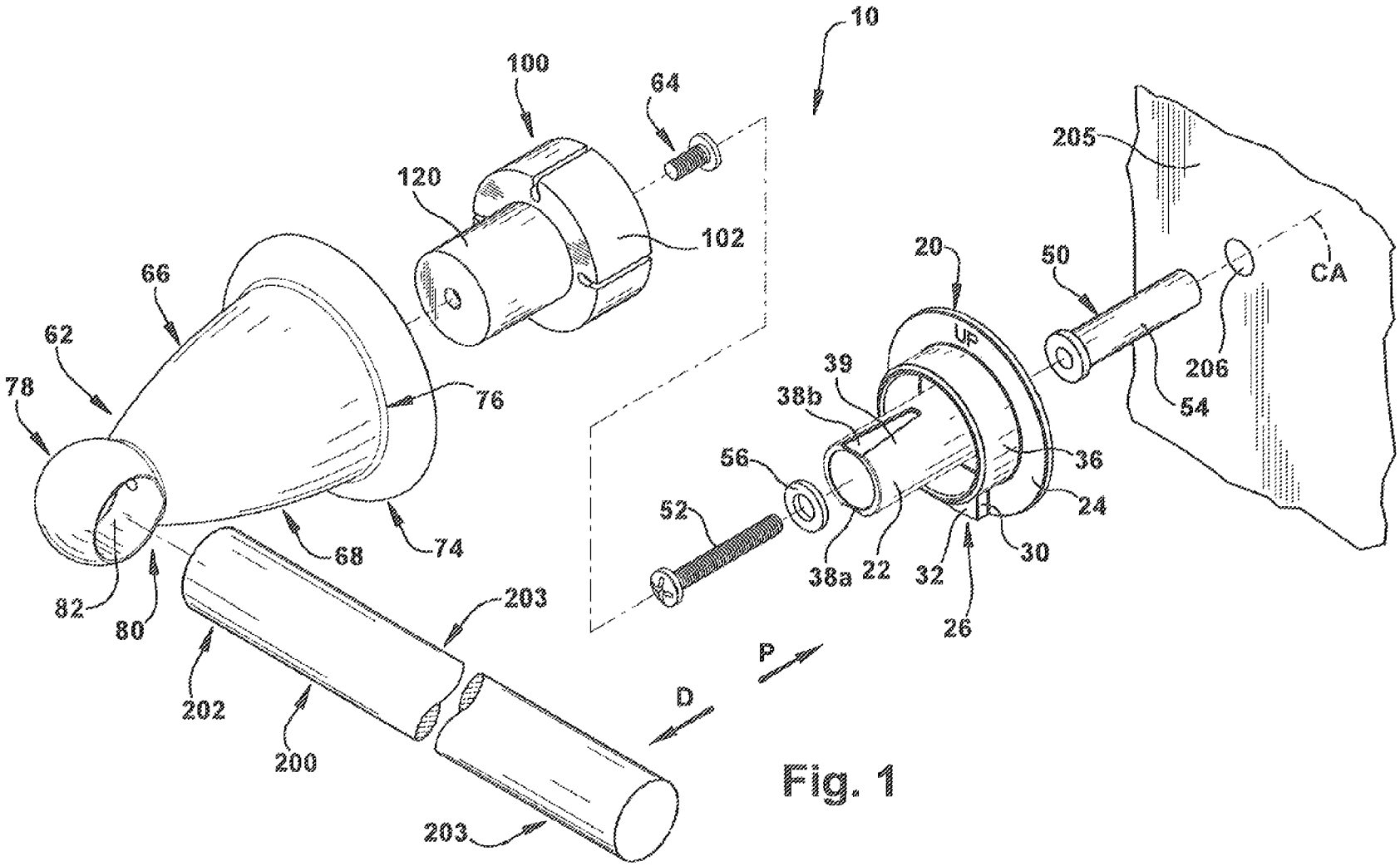
FIG. 1 is a schematic exploded perspective view of the wall-mounted support assembly for bathroom accessories constructed in accordance with one embodiment of the present disclosure.

The present disclosure provides for a wall-mounted support assembly for bathroom accessories, shown generally at 10 in FIGS. 1-2 and 6-8. The support assembly 10 includes: a) a mounting bracket 20 adapted to be affixed to a wallboard 204 forming an interior wall 204*a* of a structure, for example, forming a bathroom wall of a residential or commercial building; b) a fastener assembly 50, such as, for example, a combination of a mounting screw 53, a wall anchor 54, and a washer 56 for affixing the mounting bracket 20 to the wallboard 204; and c) an accessory post assembly 60, including an accessory post 62 and an integral post adapter 100, the accessory post assembly adapted to be releasably secured or attached to the mounting bracket 20. The support assembly 10 defines a central axis CA, shown in FIGS. 1 and 2, that, when mounted to the wallboard 204, is substantially orthogonal to an outer surface 205 of the wallboard 204.

As used herein, the term wallboard 204 is broadly used to refer to any type of building material suitable to form the wall 204*a* of a bathroom to which the mounting bracket 20 would be mounted. For example, the wallboard 204, as used herein, would broadly include walls constructed of building materials such as drywall, beadboard, tile, tileboard, plaster, paneling, etc., used in constructing a bathroom wall. As would be understood by one of skill in the art, the fastener assembly 50 may be modified as necessary depending on the bathroom wall material utilized such that a suitable mounting of the mounting bracket 20 to the wall 204*a* is achieved.

As is best seen in FIGS. 1, 4, and 6-7, the accessory post 62 of the accessory post assembly 60 includes a distal portion 78 (a portion furthest away from the wallboard 204 when the accessory post assembly 60 is mounted to the wallboard) configured to receive and support one of a plurality of bathroom accessories. For convenience purposes, in FIGS. 1, 2 and 7, the relative directions "distal" and "proximal" are labeled as D and P, respectively. As used herein as a term of direction or orientation, the term "proximal" means a direction toward the wallboard 204 when the support assembly 10 is mounted to the wallboard 204 and the term "distal" means a direction away from the wallboard 204 when the support assembly 10 is mounted to the wallboard 204. The terms "axial/axially" as terms of direction or orientation shall mean in a direction or orientation along the support assembly central axis CA, the terms "radial/radially" as terms of direction or orientation shall mean in a direction or orientation toward (radially inwardly) or away (radially outwardly) from the central axis CA, and the terms "rotational/rotationally" as terms of direction or orientation shall mean in a direction or orientation of rotating around or about the central axis CA.

Figure 3:
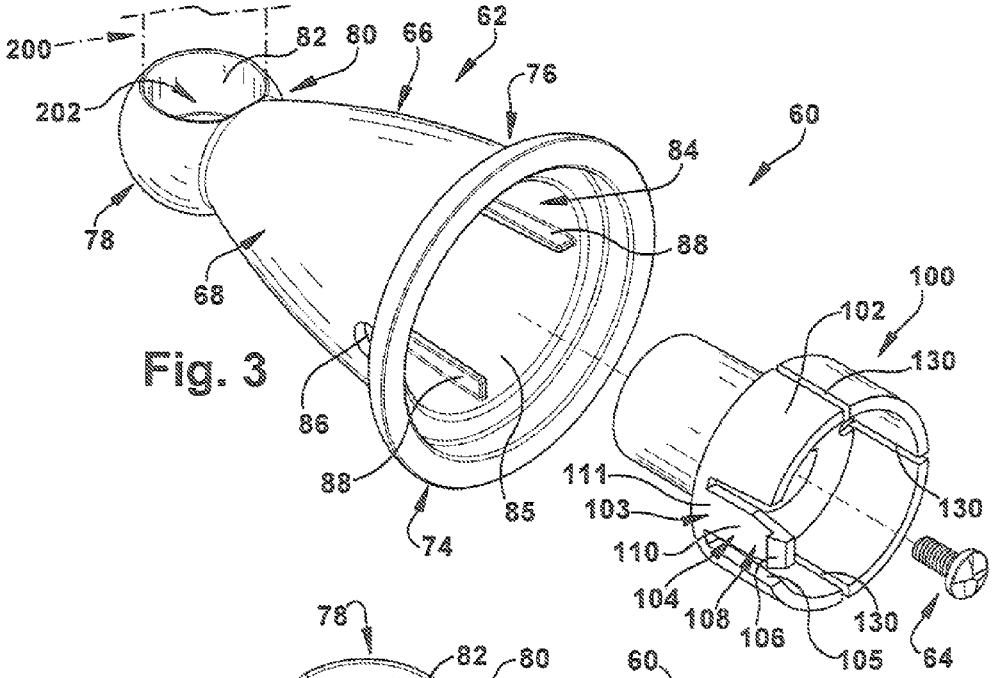
FIG. 3 is a schematic exploded perspective view of an accessory post assembly of the support assembly of FIG. 1.

The specific bathroom accessory supported by the distal portion 78 of the accessory post 62 in FIGS. 1 and 3 is a towel bar 200. Specifically, as is best seen in FIG. 3, one end 202 of the towel bar 200 is received in an opening 82 in the distal portion 78 of the accessory post 62. If the bathroom accessory to be supported is of a type that requires support at opposite ends of the accessory, then a second support assembly or some other means of support may have to be provided. For example, an opposite end 203 of the towel bar 200 would need to be supported by a second support assembly or supported in some other manner. The support assembly 10 may support a selected one of a wide variety of bathroom accessories including, by way of example, one end of a bar or rod, such as an end of a towel bar or shower rod, a towel ring, a robe hook, a washcloth hook, a toilet paper holder, a soap dish, and a shampoo rack. The specific shape of the opening 82 of the distal portion 78 will, vary depending on the bathroom accessory to be supported. For example, if the bathroom accessory to be supported is a ring, such as a towel ring, in another exemplary embodiment of the present disclosure, the opening 82 may be configured a throughbore as opposed to the recess-type opening shown in the Figures. Such alternate embodiments are within the scope of the present disclosure.

Figure 6:
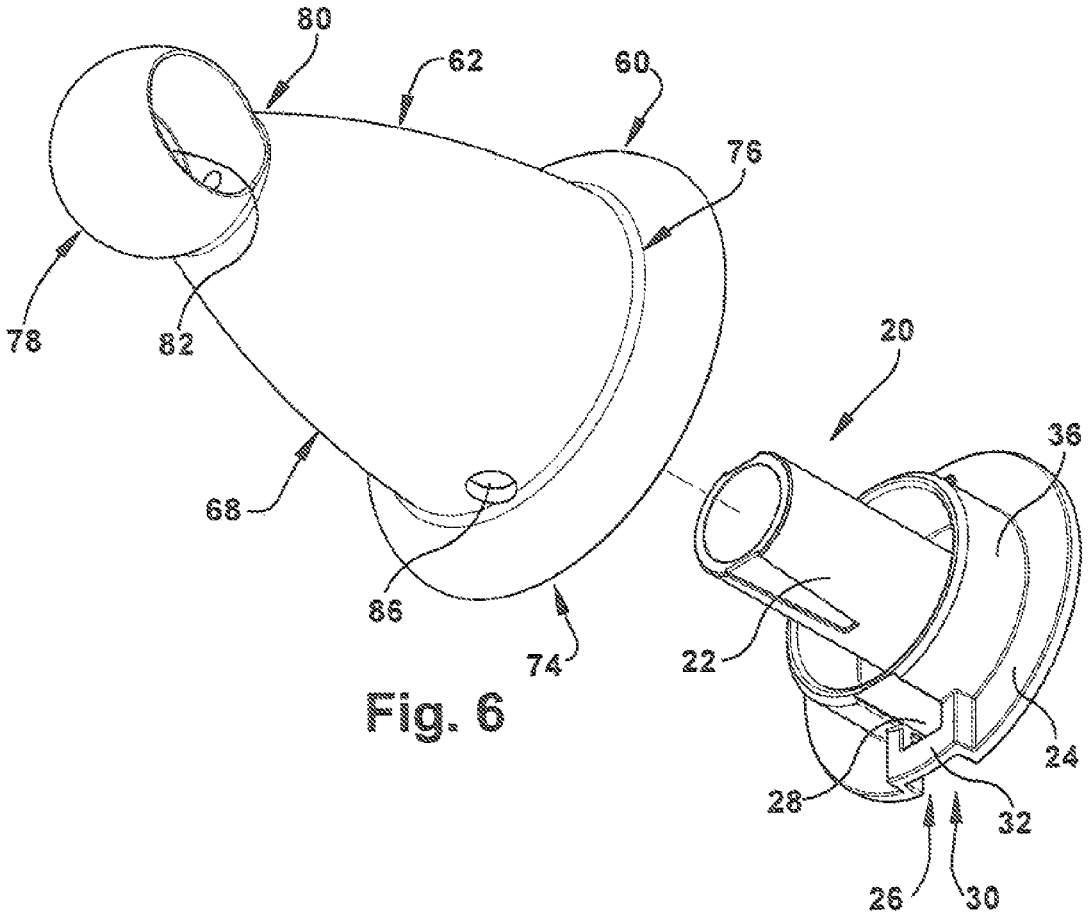
FIG. 6 is a schematic exploded perspective view of the support assembly of FIG. 1, with the accessory post assembly detached from a mounting bracket of the support assembly, the accessory post assembly being axially aligned with the mounting bracket for attachment.
Figure 7:
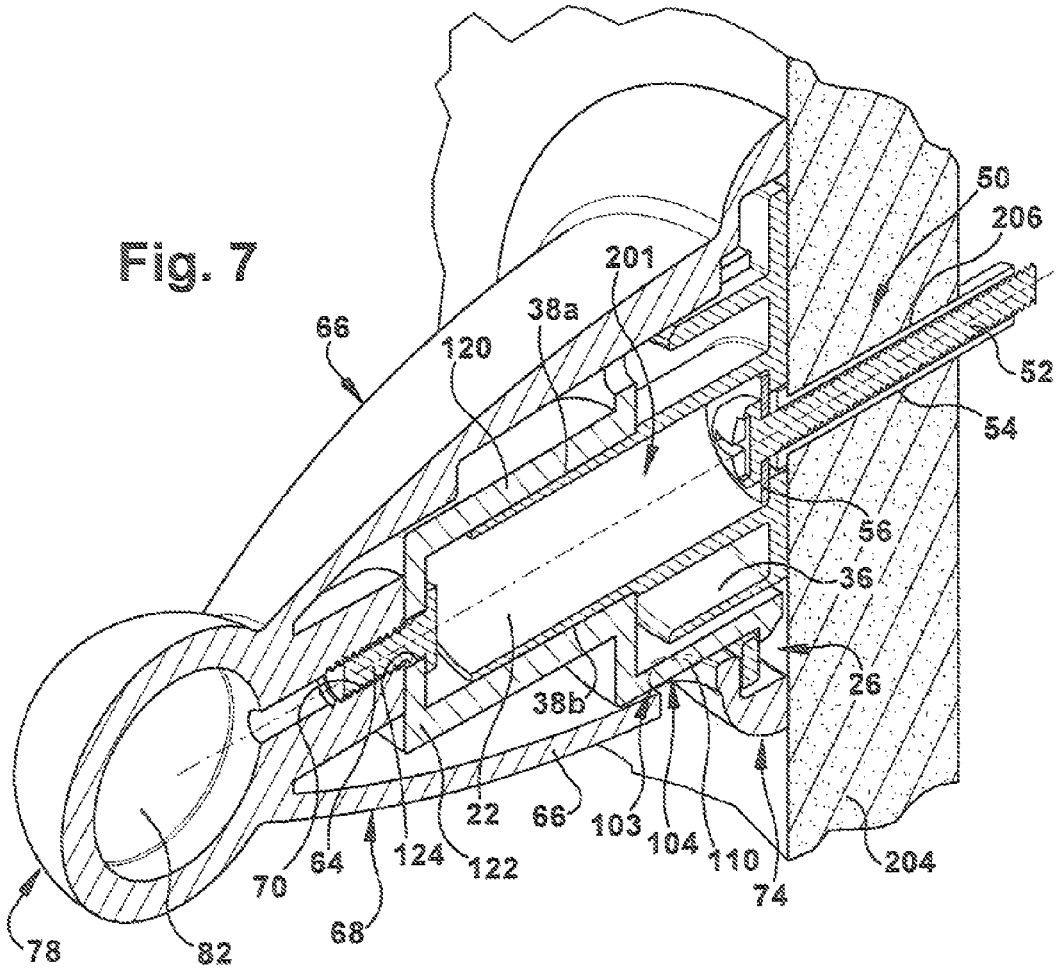
FIG. 7 is a schematic sectional view of the support assembly of FIG. 1 with a latch of a cantilevered flange latch of the accessory post assembly in a latched position with respect to a catch assembly of the mounting bracket.
Figure 8:
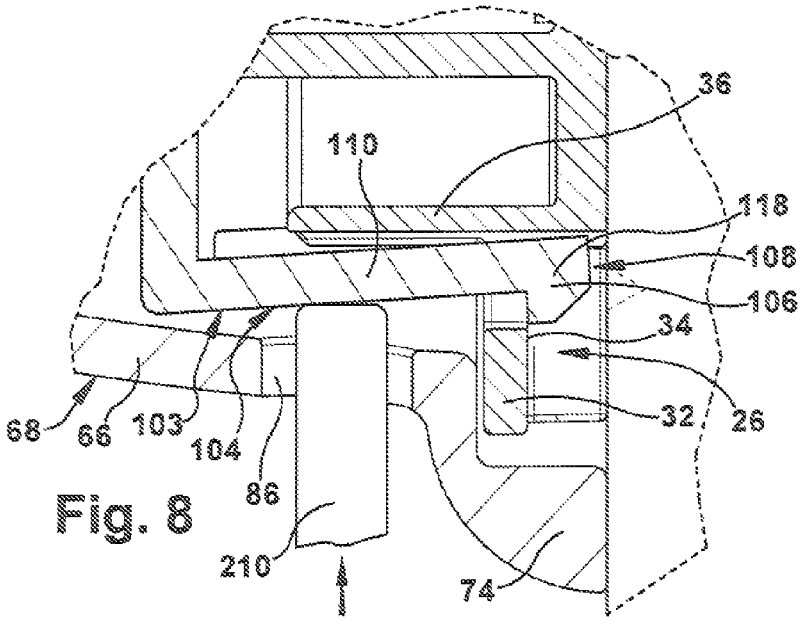
FIG. 8 is a schematic sectional view of the support assembly of FIG. 1 with the cantilevered flange latch of the accessory post assembly in an unlatched position with respect to the catch assembly of the mounting bracket, the cantilevered flange latch having been deflected to the unlatched position by a tool.

Advantageously, the support assembly 10 of the present invention provides for a secure attachment structure between the accessory post assembly 60 and the mounting bracket 20 that is both easy to attach and is easy to release. Schematic depictions of alignment, attachment and detachment of the accessory post assembly 60 and the mounting bracket 20 are shown in FIGS. 6-8. After a builder or homeowner affixes the mounting bracket 20 to the wallboard 204, the accessory post assembly 60 may be easily and quickly attached to the mounting bracket 20 without the need for any tools, use of set screws, etc. By the same token, if it is desired at some point to detach the accessory post assembly 60 from the mounting bracket 20 to, for example, change the bathroom accessory 200 being support from a towel bar to a towel ring which would require a differently configured accessory port distal portion 78, the accessory post assembly 60 may be detached from the mounting bracket 20 easily and quickly with the use of a small diameter tool 210, such as a small diameter rod or screwdriver, as will be explained below, without the need for unscrewing set screws, etc.

Accessory Post Assembly 60

Figure 4:
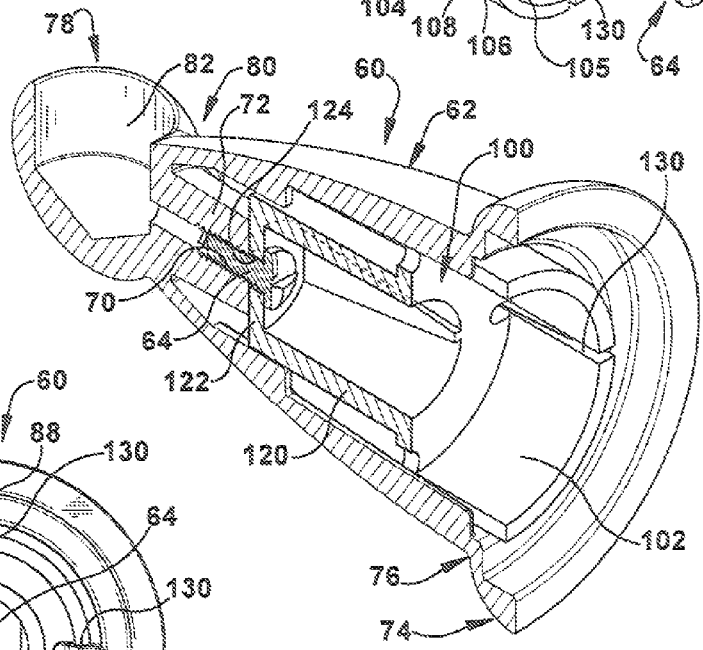
FIG. 4 is schematic perspective view with section cut away of the support assembly of FIG. 1.
Figure 5:
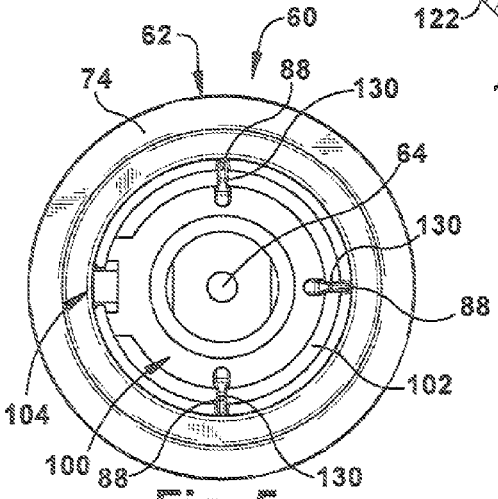
FIG. 5 is a schematic bottom plant view of the support assembly of FIG. 1.

As can best be seen in FIGS. 3-5, the accessory post assembly 60 includes the accessory post 62 and the post adapter 100, which is permanently affixed to the accessory post 62 thereby comprising the integral accessory post assembly. Specifically, in one exemplary embodiment of the support assembly 10 of the present disclosure, a tamper resistant fastener 64, such as a tamper resistant screw, is used to affix the accessory post 62 and the post adapter 100. The tamper resistant fastener or screw 64 passes through an opening 124 in an upper, distal end 122 of an upper or distal cylinder 120 of the post adapter 100 and is threaded into a threaded opening 70 formed in an upper portion 72 of a central body 68 of the accessory post 62. The tamper resistant screw 64 cannot be removed from the threaded opening 70 without destroying or damaging the accessory post 62 and/or the post adapter 100.

The tamper resistant fastener or screw 64 may be, for example, a tamper resistant machine screw (such as Grainger Industrial Supply product number 5JY99-#6-32×0.375" long tamper resistant machine screw or equivalent). Alternately, as would be understood by one of ordinary skill in the art, a number of permanent attachment structures and/or connectors and/or fasteners could be used to permanently affix the post adapter 100 and the accessory post 62 including adhesives, molding, ultrasonic and other methods of welding, riveting, among others known to those of skill in the art. Additionally, as would be recognized by one of skill in the art, the post adapter and accessory post may be fabricated as a single piece unit. It is the intent of the present disclosure to cover all such configurations and attachment structures/connectors/fasteners and such configurations and attachment structures are alternate embodiments of the present disclosure.

Accessory Post 62

Figure 2:
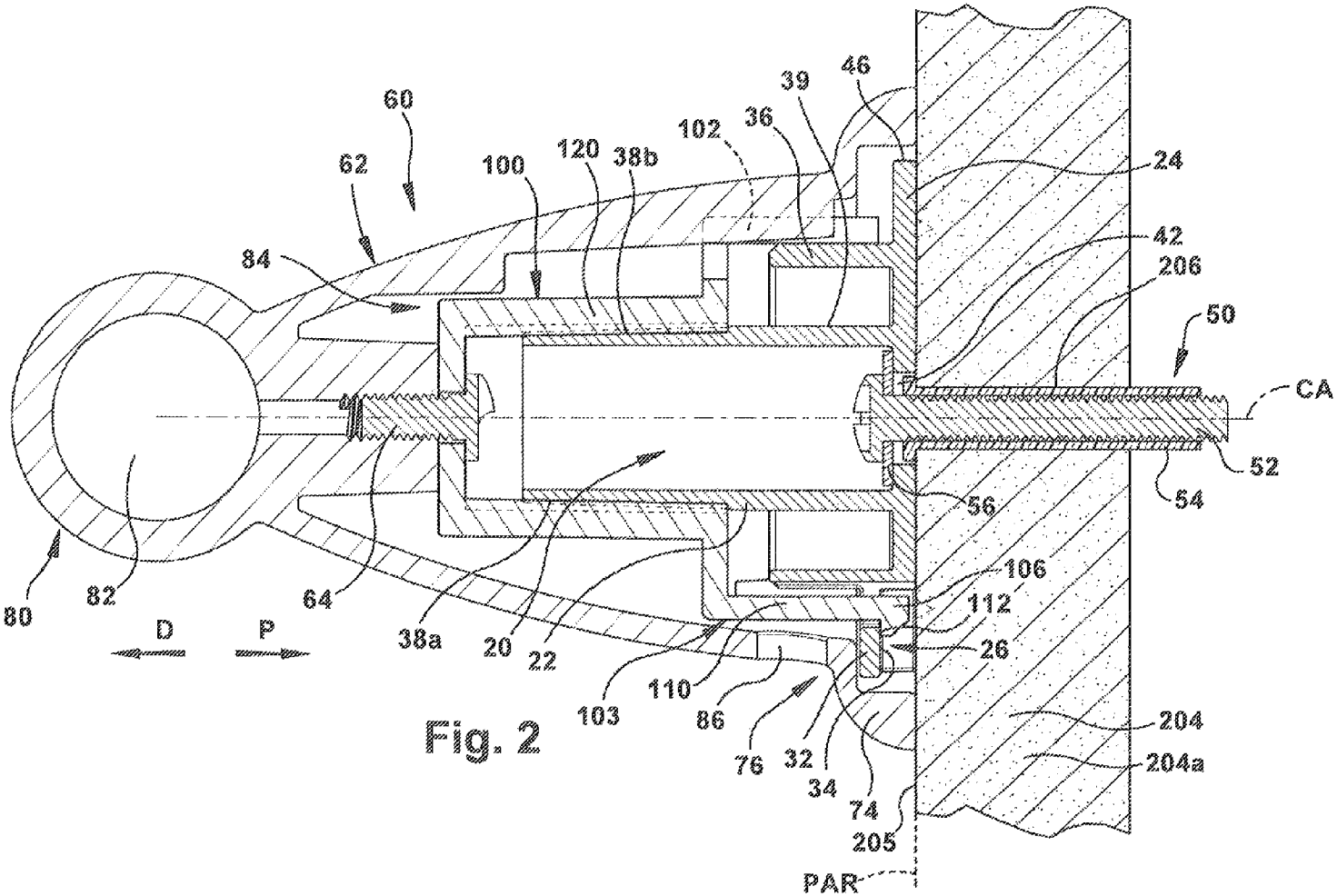
FIG. 2 is a schematic sectional view of the support assembly of FIG. 1 as mounted to a wallboard, the sectional view being taken along a central axis of the support assembly.
Figure 9:
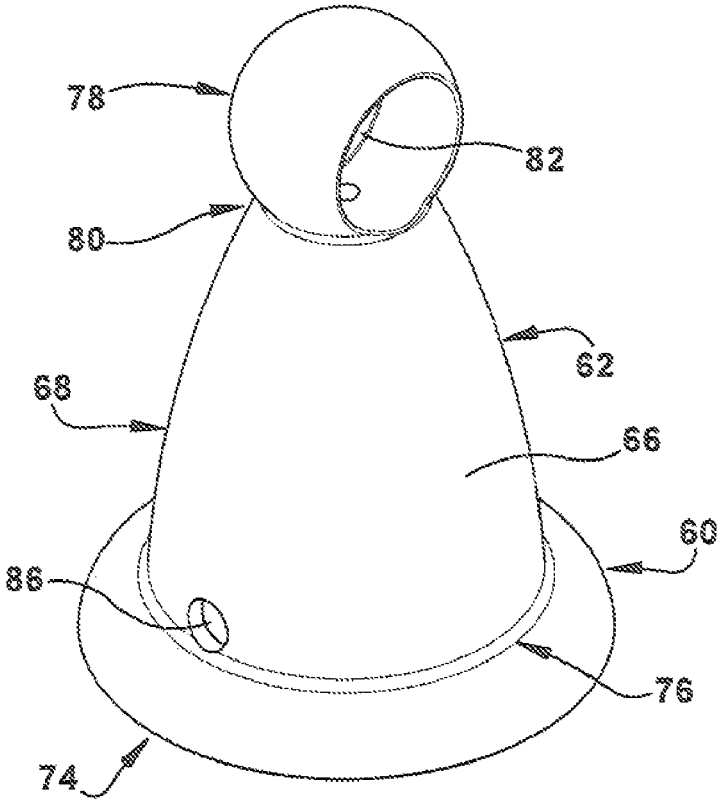
FIG. 9 is a schematic perspective view of an accessory post of the accessory post assembly of the support assembly of FIG. 1.
Figure 10:
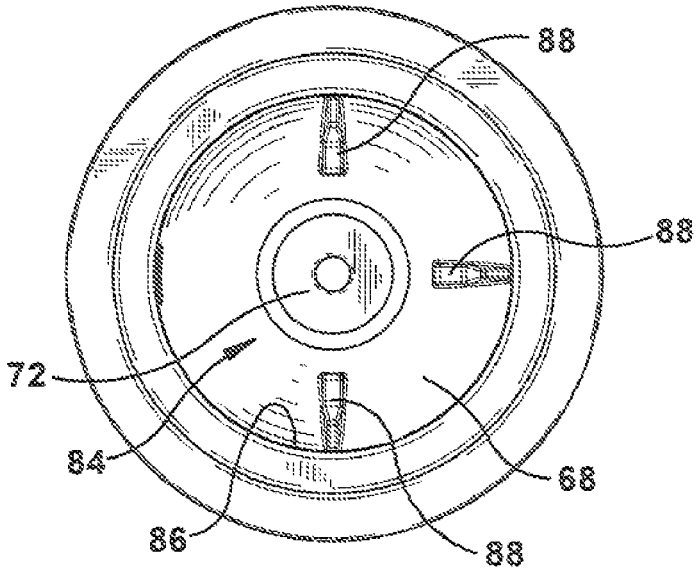
FIG. 10 is a schematic bottom plan view of the accessory post of FIG. 9.

As can best be seen in FIGS. 9 and 10, the accessory post 150 includes a generally bell-shaped wall 66. The wall defines a central body 68. As discussed above, the upper portion 72 of the central body 68 defines the threaded opening 72 (FIG. 4). A base 74 extends from one end (a proximal end) of the central body 68. The base 74, which is part of the wall 66, extends generally radially outwardly from the central body 68 and axially in a proximal direction away from the central body 68. As can be seen in FIG. 2, the base 74 is configured and sized to overlie an outer peripheral edge 46 of the mounting post 20 and contact the surface 205 of the wallboard 204 when the accessory post assembly 60 is mounted to the mounting bracket 20 such that the mounting bracket is not visible.

As can best be seen in FIGS. 3 and 4, the accessory post 62 further includes the distal portion 78 extending axially from a second end 80 (a distal end) of the central body 68. As described above, the distal portion 78 defines an opening 82 that supports the selected bathroom accessory 200. As can best be seen in FIG. 4, the threaded opening 70 of the central body 68 includes a non-threaded portion that extends axially in a distal direction and intersects the opening 82 of the distal portion 78. An inner surface 85 of the wall 66 defines an open interior region 84 in which the post adapter 100 is disposed. As can best be seen in FIGS. 7 and 8, the accessory post wall 66 includes an access opening 86 that permits access to a cantilevered flange 104 of the post adapter 100. As will be explained below, the cantilevered flange 104 is part of a latch mechanism 103 of the accessory post assembly 60.

When assembling the post adapter 100 and the accessory post 62 so that they are permanently affixed, proper alignment of the cantilevered flange 104 and the access opening 86 is assured by three alignment ribs 88 projecting from the inner surface 85 of the accessory post wall 66 which interfit into mating slots 130 formed in an outer surface 132 of a generally cylindrical pedestal 102 of the post adapter 100. The interfit of the alignment ribs 88 and the slots 130 assure proper rotational alignment of the accessory post 62 and the post adapter 100 prior to the accessory post 62 and the post adapter 100 being permanently affixed with the tamper resistant fastener 64.

Post Adapter 100

Figure 11:
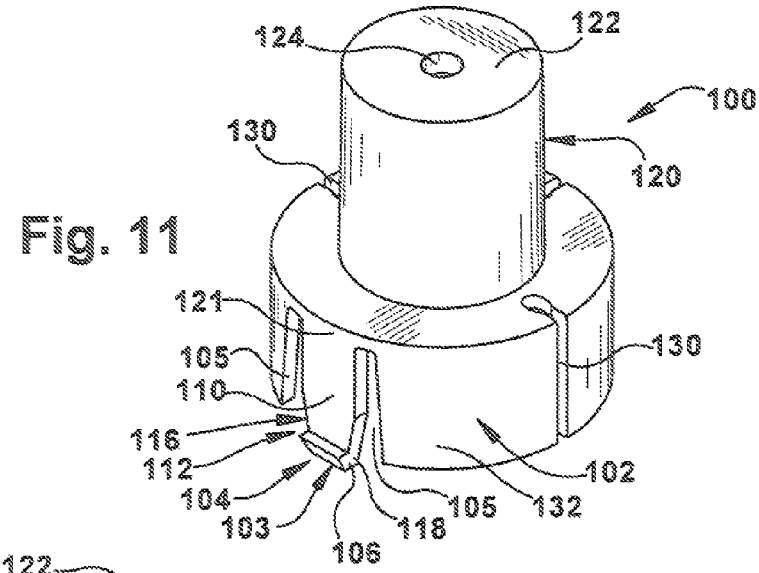
FIG. 11 is a schematic perspective view of a post adapter of the accessory post assembly of the support assembly of FIG. 1.
Figure 12:
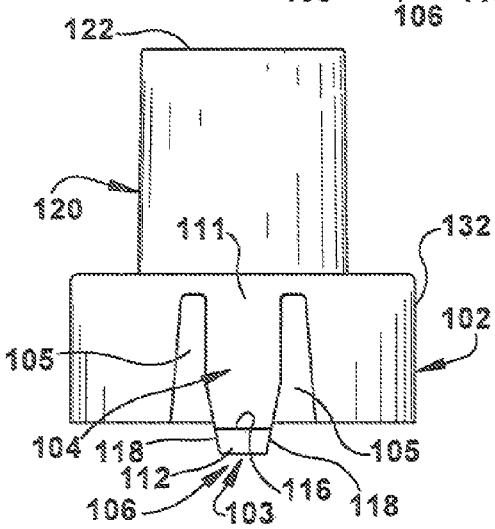
FIG. 12 is a schematic front elevation view of the post adapter of FIG. 11.

The post adapter 100 includes the lower or proximal pedestal 102 and the radially narrower, upper or distal cylinder 120, both centered about the central axis CA. As discussed above, the tamper resistant fastener 64 passes through the opening 124 in the distal end 122 of the upper or distal cylinder 120. The lower pedestal 102 of the post adapter 100 also includes the latch mechanism 103 of the accessory post assembly 60. The pedestal 102 includes a pair of axially extending slots 105 (best seen in FIGS. 11 and 12) that define the cantilevered flange 104 of the latch mechanism 103.

Figure 13:
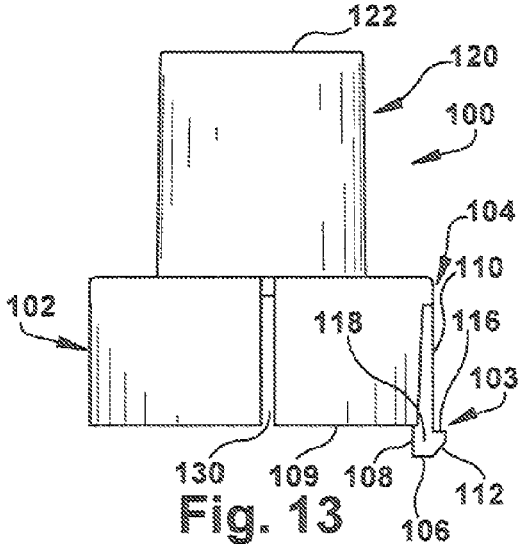
FIG. 13 is a schematic side elevation view of the post adapter of FIG. 11.
Figure 14:
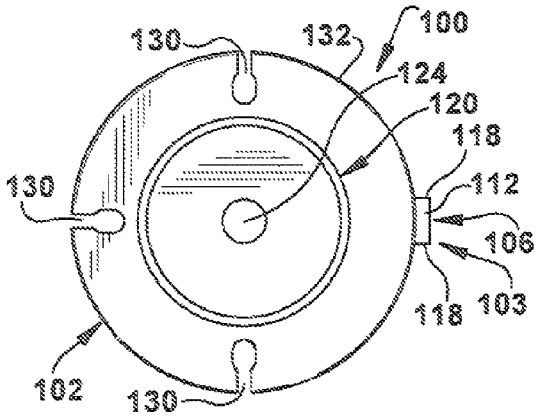
FIG. 14 is a schematic top plan view of the post adapter of FIG. 11.
Figure 15:
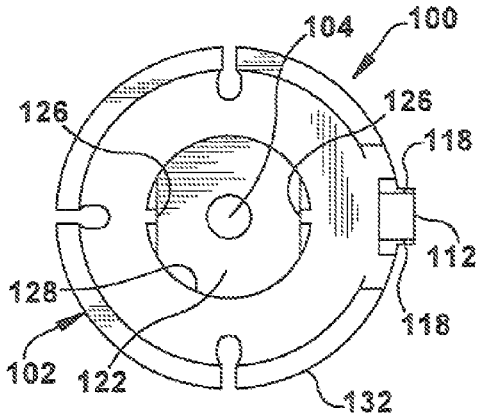
FIG. 15 is a schematic bottom plan view of the post adapter of FIG. 11.
Figure 19:
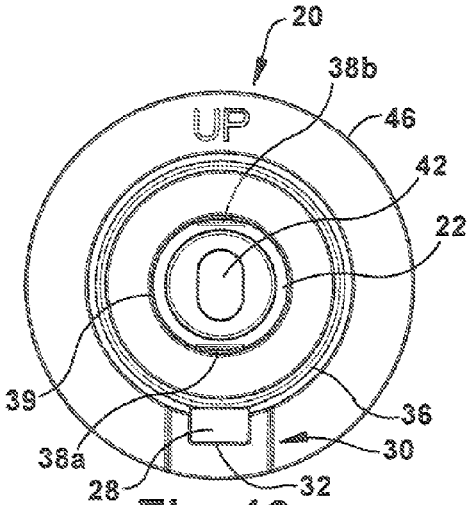
FIG. 19 is a schematic top plan view of the mounting bracket of FIG. 16.
Figure 16:
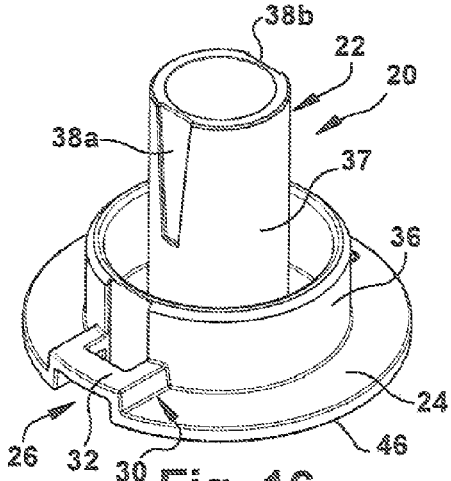
FIG. 16 is a schematic perspective view of the mounting bracket of the support assembly of FIG. 1.

The cantilevered flange 104 of the lower pedestal 102 includes an L-shaped latch 106 at a free end 108 (proximal end) (FIG. 13) of the cantilevered flange 104. As can be seen in FIG. 13, the distal end 108 of the cantilevered flange 104 extends axially beyond a proximal end 109 of the pedestal 102. Hence, the L-shaped latch 106 extends below the proximal end 109 of the pedestal 102. An intermediate region 110 of the cantilevered flange 104 is spaced from the L-shaped latch 106 and is disposed between the latch 106 and a connected end 111 (FIGS. 3 and 11-12) of the flange 104. The intermediate region of the cantilevered flange 104 is axially and rotationally allaligned with the access opening 86 of the accessory post 64 and is offset radially inwardly from the access opening (best seen in FIGS. 7 and 8).

When the accessory post assembly 60 is attached to the mounting bracket 20, contacting or bearing surfaces of the L-shaped latch 106 and the rib 32 of the mounting bracket 20 prevent relative axial movement between the accessory post assembly 60 and the mounting bracket 20. Specifically, a bearing surface 116 of the L-shaped latch 106 bears against a mating bearing surface 34 of the rib 32 to inhibit axial movement of the accessory post assembly 60 relative to the mounting bracket 20 in the distal direction D (in a direction away from the wallboard 204). Axial movement of the accessory post assembly 60 relative to the mounting bracket 20 in a distal direction is not a concern because contact of the accessory post base 74 with the surface 205 of the wallboard 204 would inhibit any axial movement in the proximal direction P (in a direction toward the wallboard).

As is best seen in FIGS. 2 and 7, when the accessory post assembly 60 is attached to the mounting bracket 20, a snap fit engagement between the L-shaped latch 106 of the post adapter 100 and the rib 32 of the mounting bracket 20 secures the accessory post assembly 60 to the mounting bracket 20. Specifically, as the L-shaped latch 106 of the cantilevered flange 104 passes through a latch opening 28 of the mounting bracket catch mechanism 26, a radially outward extending projection 112 (FIGS. 11-15) of the L-shaped latch 106 of the cantilevered flange 104 is deflected radially inwardly by the rib 32. As the projection 112 passes the rib 32, the cantilevered flange 104 snaps back to its undeflected condition. The bearing surface 116 of the L-shaped latch 106 bears against the mating bearing surface 34 of the rib 32 to prevent relative axial movement in the distal direction D. Rotational movement between the accessory post assembly 60 and the mounting bracket 20 is inhibited by contact between opposite side portions 118 (FIGS. 8 and 12-15) of the L-shaped latch 106 and the boss 30 of the mounting bracket catch mechanism 26.

Mounting Bracket 20

The mounting bracket 20 of the support assembly is best seen in FIGS. 1-4 and 16-20 and includes a generally cylindrical sleeve 22 and a radially extending annular rim 24 that extends radially outwardly from the sleeve 22. The annular rim 24 that, when installed, abuts the wallboard 204. A general extent of the annular rim 24 is planar. The general extent of the annular rim 24 is shown schematically as a plane PAR in FIG. 2. The plane PAR is substantially parallel to the surface 205 of the wallboard 204. The annular rim 24 defines the catch mechanism 26 which operatively interacts with a latch mechanism 103 of the accessory post assembly 60 to releasably secure the accessory post assembly 60 to the mounting bracket 20. The mounting bracket catch mechanism 26 includes the latch opening 28 and a boss 30 protruding axially from the rim 24. The boss 30 includes a rib 32 which is parallel to but axially offset from the plane PAR of the annular rim 24. The rib 24 includes a bearing surface 34, that is, a surface that is in contact with the L-shaped latch 106 of the accessory post assembly latch mechanism 103 when the accessory post assembly 60 is secured to the mounting bracket 20.

As is best seen in FIGS. 6 and 16-19, the mounting bracket 20 further includes an axially extending cylindrical collar 36 extending axially from the annular rim 24. The boss 30 exends radially outwardly from the cylindrical collar 36 and axially in a distal direction from the annular rim 24. The cylindrical collar 36 defines one side of the latch opening 28 and the boss 30 defining a remainder of the opening 28. The rib 32 includes a surface 34 which contacts and acts as a bearing surface for the mating bearing surface 116 of the L-shaped latch 106 of the accessory post assembly latch mechanism 103.

As is best seen in FIGS. 16-19, the mounting bracket 20 additionally includes a pair of recesses 38*a*, 38*b* in an outer surface 39 of the sleeve 22. The sleeve recesses 38*a*, 38*b* receive respective radially inwardly extending projections 126 (FIG. 15) of an inner surface 128 of the post adapter upper cylinder 120. As can best be seen in FIGS. 16 an 17, the recesses 38*a*, 38*b* are tapered, that is, being wider at a distal or upper end and narrower at a proximal or lower end of the recess. The tapering of the recess 38*a*, 38*b* serve to guide the mating projection 126 and thereby properly rotationally align the L-shaped latch 106 of the latch mechanism 103 of the accessory post assembly 60 with the opening 28 of the catch mechanism 26 of the mounting bracket 20 as the accessory post assembly 60 is moved axially toward and secured to the mounting bracket 20. Additionally, the interfitting of the sleeve recesses 38*a*, 38*b* and the mating upper cylinder projections 126 serves to inhibit rotational movement between the accessory post assembly 62 and the mounting bracket 20.

Figure 17:
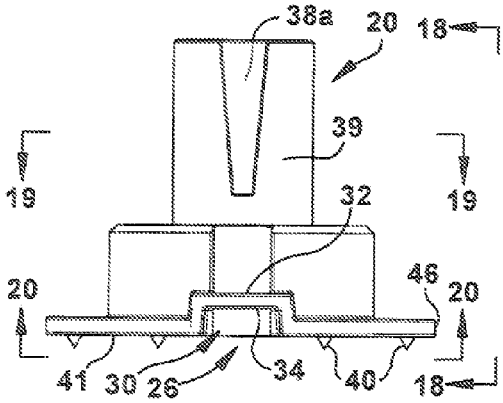
FIG. 17 is a schematic front elevation view of the mounting bracket of FIG. 16.
Figure 18:
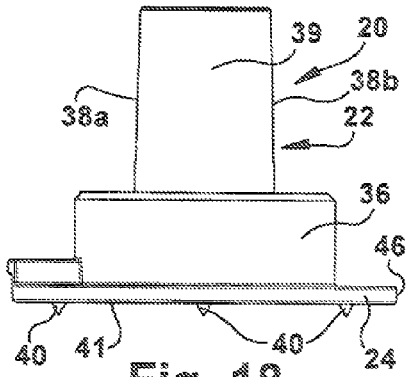
FIG. 18 is a schematic front side elevation view of the mounting bracket of FIG. 16.
Figure 20:
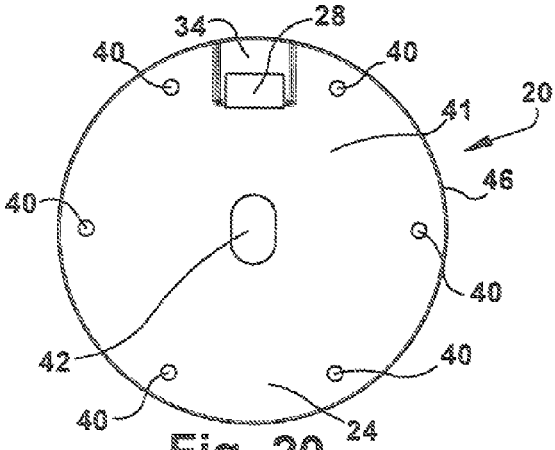
FIG. 20 is a schematic bottom plan view of the mounting bracket of FIG. 16.

As is best seen in FIGS. 17, 18 and 20, the annular rim 24 includes a plurality of short projections or spikes 40 that extend from a lower or distal surface 41 of the rim 24 and protrude into the surface 205 of the wallboard 204 to inhibit rotational movement of the assembled support assembly 10 with respect to the wallboard 204.

Fastener Assembly 50

The fastener assembly 50 includes the wall anchor 54 disposed in an opening 206 in the wallboard 204. A threaded portion of the mounting screw 52 passes through a central opening 42 of the mounting bracket 20 and extends into the wall anchor 54 to affix the mounting bracket 20 to the wallboard 204. The mounting screw 52 is substantially coaxial or congruent with the central axis CA. The washer 56 abuts a radially inwardly extending waist 44 within the sleeve 22 of the mounting bracket 20 and provides a bearing surface for a head of the mounting screw 52. Again, as mentioned previously, the term wallboard 204 broadly refers to any building material suitable for constructing a bathroom wall 204*a* including, for example, drywall, tile, tileboard, paneling, beadboard, plaster, etc. Depending on the particular material of the wallboard 204, the fastener assembly 50 may be modified, as would be understood by one of ordinary skill in the art, to properly secure the mounting bracket 20 to the wallboard 204.

Attaching Accessory Post Assembly 60 to Mounting Bracket 20

To affix the accessory post assembly 60 to the mounting bracket 20, the accessory post assembly 60 is oriented with respect to the mounting bracket 20 such that the accessory post assembly 60 is axially aligned with the mounting bracket 20 and the cantilevered flange 104 of the accessory post assembly latch mechanism 103 is in rotational aligned with the catch mechanism 26 of the mounting bracket 20. For rotational alignment purposes, the access opening 86 in the side wall 66 of the accessory post 62 provides a visual cue to where the cantilevered flange 104 is positioned with respect to the accessory post.

After alignment, the accessory post assembly 60 is moved axially in a proximal direction P toward and engages the mounting flange 20 such that a snap fit engagement between the L-shaped latch 106 of the post adapter 100 and the rib 32 of the mounting bracket 20 secures the accessory post assembly 60 to the mounting bracket 20. Specifically, as the L-shaped latch 106 of the cantilevered flange 104 passes through the opening 28 of the mounting bracket catch mechanism 26, the radially outward extending projection 112 (FIGS. 11-15) of the L-shaped latch 106 of the cantilevered flange 104 is deflected radially inwardly by the rib 32. As the projection 112 passes the rib 32, the cantilevered flange 104 snaps back to its undeflected condition. The bearing surface 116 of the L-shaped latch 106 bears against the mating bearing surface 34 of the rib 32 to inhibit relative axial movement between the accessory post assembly 60 and the mounting bracket 20 in the distal direction D. Rotational movement between the accessory post assembly 60 and the mounting bracket 20 is inhibited by contact between the side portions 118 (FIGS. 8 and 12-15) of the L-shaped latch 106 and the boss 30 of the mounting bracket catch mechanism 26. Further, rotational movement between the accessory post assembly 62 and the mounting bracket 20 is also inhibited by the interfitting of the two radially inwardly extending projections 126 (FIG. 15) of the inner surface 128 of the post adapter upper cylinder 120 into the corresponding recesses 38*a*, 38*b* of the mounting bracket sleeve 22.

Detaching Post Assembly 60 from Mounting Bracket 20

To release the accessory post assembly 190 from the mounting bracket 120, a narrow tool 210 such as a rod or a working end of a screwdriver is inserted through the access opening 86 of the accessory post 62 to deflect the cantilevered flange 104 of the latch mechanism 103 of the post adapter 100 and cause the L-shaped latch 106 to deflect radially inwardly and disengage from the rib 32 of the catch mechanism 26 of the mounting bracket 20. Since the access opening 86 is aligned with the intermediate region 110 of the cantilevered flange 104, the end of the tool 210 will contact and seat in the intermediate region 110. Pushing radially inwardly on the intermediate region 110 causes the cantilevered flange 104 and, specifically, the L-shaped latch 104 to deflect radially inwardly. Sufficient inward movement of the intermediate region 110 causes the L-shaped latch 104 to disengage from the rib 32 of the mounting bracket 20 thereby allowing the accessory post assembly 60 to be moved axially away in the distal direction D from engagement with the mounting bracket 20.

As used herein, terms of direction and/or orientation such as proximal, distal, axial, axially, radial, radially, rotational, rotatationally, upper, lower, inward, outward, etc., are provided for convenience purposes and relate generally to the orientation shown in the Figures. Such direction and/or orientation terms are not intended to limit the scope of the present disclosure or the claims appended hereto.

What have been described above are examples of the present disclosure/invention. It is, of course, not possible to describe every conceivable combination of components, assemblies, or methodologies for purposes of describing the present disclosure/invention, but one of ordinary skill in the art will recognize that many further combinations and permutations of the present disclosure/invention are possible. Accordingly, the present disclosure/invention is intended to embrace all such alterations, modifications, and variations that fall within the spirit and scope of the appended claims.

What is claimed is:

1. A wall-mounted support assembly for supporting a bathroom accessory adapted to be affixed to a wallboard, the support assembly extending along a central axis transverse to a surface of a wallboard when the support assembly is affixed to a wallboard, the support assembly comprising:

a mounting bracket;

a fastener assembly adapted to affix the mounting bracket to a wallboard;

an accessory post assembly including an accessory post and a post adapter permanently affixed to the accessory post, the accessory post includes a wall defining a central body and a distal portion extending axially from an end of the central body, the distal portion configured to support a bathroom accessory, the accessory post wall defining an open interior region and an access opening extending through the wall, the post adapter disposed within the interior region of the accessory post wall and including an axially extending pedestal that includes a cantilevered flange disposed between a pair of axially extending slots, the cantilevered flange having a latch at a free end of the flange and an intermediate region spaced from the free end, the intermediate region being peripherally aligned with the accessory post wall access opening; and the mounting bracket including a radially extending annular rim for abutting a wallboard when the support assembly is mounted to a wallboard, the mounting bracket annular rim defining a catch mechanism including a latch opening and a boss protruding axially from the rim, the latch opening and boss of the catch mechanism adapted to allow the latch to pass through the latch opening and engage the boss to releasably secure the accessory post assembly to the mounting bracket.

2. The support assembly of claim 1 wherein the accessory post and post adapter are permanently affixed with a tamper resistant screw.

3. The support assembly of claim 1 wherein the mounting bracket includes an axially extending cylindrical collar extending from the annular rim, the boss extending radially outwardly from the cylindrical collar and the cylindrical collar defining one side of the latch opening and the boss defining a remainder of the latch opening.

4. The support assembly of claim 3 wherein the mounting bracket cylindrical collar engages the axially extending pedestal of the post adapter when the accessory post assembly is releasably secured to the mounting bracket.

5. The support assembly of claim 1 wherein the mounting bracket includes an axially extending cylindrical sleeve disposed at a radially inner periphery of the annular rim, the sleeve including a recess in an outer surface of the sleeve, the recess adapted to slidably receive a radially inwardly extending projection on an inner surface of the post adapter to rotationally orient the accessory post assembly with respect to the mounting bracket when the accessory post assembly is moved axially relative to the mounting bracket to releasably secure the accessory post assembly to the mounting bracket.

6. The support assembly of claim 1 wherein the latch of the cantilevered flange is an L-shaped latch bearing against a rib defined by the boss of the catch mechanism when the accessory post assembly is releasably secured to the mounting bracket, the rib being substantially parallel to a general extent of the annular rim of the mounting bracket.

7. The support assembly of claim 1 wherein the latch of the cantilevered flange extends axially beyond an end of the post adapter pedestal.

8. The support assembly of claim 1 wherein the accessory post further includes a base extending radially outwardly from the central body to overlie an outer peripheral surface of the annular rim of the mounting bracket when the accessory post assembly is releasably secured to the mounting bracket.

9. The support assembly of claim 5 wherein the fastener assembly includes a mounting screw that extends through a waist defining a central opening, the waist disposed within the sleeve of the mounting bracket.

10. The support assembly of claim 1 wherein the central axis of the support assembly is substantially orthogonal to a surface of a wallboard when the support assembly is affixed to a wallboard.

11. A wall-mounted support assembly for supporting a bathroom accessory adapted to be affixed to a wallboard, the support assembly extending along a central axis transverse to a surface of a wallboard when the support assembly is affixed to a wallboard, the support assembly comprising:

a mounting bracket;

a fastener assembly adapted to affix the mounting bracket to a wallboard;

an accessory post assembly including an accessory post and a post adapter permanently affixed to the accessory post, the accessory post includes a wall defining a central body and a distal portion extending axially from an end of the central body, the distal portion configured to support a bathroom accessory, the accessory post wall defining an open interior region and an access opening extending through the wall, the post adapter disposed within the interior region of the accessory post wall and including an axially extending pedestal that includes a cantilevered flange disposed between a pair of axially extending slots, the cantilevered flange having a latch at a free end of the flange and an intermediate region spaced from the free end, the intermediate region being peripherally aligned with the accessory post wall access opening;

the mounting bracket including a radially extending annular rim for abutting a wallboard when the support assembly is mounted to a wallboard, the mounting bracket annular rim defining a catch mechanism including a latch opening and a boss protruding axially from the rim;

wherein, to releasably attach the accessory post assembly to the mounting bracket, the accessory post assembly is axially aligned with the mounting bracket and is moved axially toward the mounting bracket such that the post adapter latch passes through the catch mechanism latch opening and engages the boss of the catch mechanism; and wherein, to detach the accessory post assembly from the mounting bracket, the intermediate region of the cantilevered flange is contacted through the accessory post access opening and deflected radially inwardly and the accessory post assembly is moved axially away from the mounting bracket such that the post adapter latch passes through the catch mechanism latch opening and disengages from the catch mechanism.

12. The support assembly of claim 11 wherein the accessory post and post adapter are permanently affixed with a tamper resistant screw.

13. The support assembly of claim 11 wherein the mounting bracket includes an axially extending cylindrical collar extending from the annular rim, the boss extending radially outwardly from the cylindrical collar and the cylindrical collar defining one side of the opening and the boss defining a remainder of the opening.

14. The support assembly of claim 13 wherein the mounting bracket cylindrical collar engages the axially extending pedestal of the post adapter when the accessory post assembly is releasably attached to the mounting bracket.

15. The support assembly of claim 11 wherein the mounting bracket includes an axially extending cylindrical sleeve disposed at a radially inner periphery of the annular rim, the sleeve including a recess in an outer surface of the sleeve, the recess adapted to slidably receive a radially inwardly extending projection on an inner surface of the post adapter to rotationally orient the accessory post assembly with respect to the mounting bracket when the accessory post assembly is moved axially relative to the mounting bracket to releasably secure the accessory post assembly to the mounting bracket.

16. The support assembly of claim 11 wherein the latch of the cantilevered flange is an L-shaped latch bearing against a rib defined by the boss of the catch mechanism when the accessory post assembly is releasably attached to the mounting bracket, the rib being substantially parallel to a general extent of the annular rim of the mounting bracket.

17. The support assembly of claim 11 wherein the latch of the cantilevered flange extends axially beyond an end of the post adapter pedestal.

18. The support assembly of claim 11 wherein the accessory post further includes a base extending radially outwardly from the central body to overlie an outer peripheral surface of the annular rim of the mounting bracket when the accessory post assembly is releasably secured to the mounting bracket.

19. The support assembly of claim 15 wherein the fastener assembly includes a mounting screw that extends through a waist defining a central opening, the waist disposed within the sleeve of the mounting bracket.

20. The support assembly of claim 11 wherein the central axis of the support assembly is substantially orthogonal to a surface of a wallboard when the support assembly is affixed to a wallboard.

21. A method of releasably attaching and detaching an accessory post assembly of a wall-mounted support assembly from a mounting bracket of the wall-mounted accessory support assembly wherein the mounting bracket is affixed to a wallboard, the steps of the method comprising:

a) providing a wall-mounted support assembly including: a mounting bracket; a fastener assembly adapted to affix the mounting bracket to a wallboard; an accessory post assembly including an accessory post and a post adapter permanently affixed to the accessory post, the accessory post includes a wall defining a central body and a distal portion extending axially from an end of the central body, the distal portion configured to support a bathroom accessory, the accessory post wall defining an open interior region and an access opening extending through the wall, the post adapter disposed within the interior region of the accessory post wall and including an axially extending pedestal that includes a cantilevered flange disposed between a pair of axially extending slots, the cantilevered flange having a latch at a free end of the flange and an intermediate region spaced from the free end, the intermediate region being peripherally aligned with the accessory post wall access opening; and the mounting bracket including a radially extending annular rim for abutting a wallboard when the support assembly is mounted to a wallboard, the mounting bracket annular rim defining a catch mechanism including a latch opening and a boss protruding axially from the rim, the latch opening and boss of the catch mechanism adapted to allow the latch to pass through the latch opening and engage the boss to releasably secure the accessory post assembly to the mounting bracket;

b) attaching the accessory post assembly to the mounting bracket by axially aligning the accessory post assembly with the mounting bracket and moving the accessory post assembly toward the mounting bracket such that the post adapter latch passes through the catch mechanism latch opening and engages the boss of the catch mechanism to attach the accessory post assembly to the mounting bracket; and c) detaching the accessory post assembly from the mounting bracket by contacting and deflecting radially inwardly the intermediate region of the cantilevered flange through the accessory post access opening and moving the accessory post assembly axially away from the mounting bracket such that the post adapter latch passes through the catch mechanism latch opening and disengages from the catch mechanism to detach the accessory post assembly from the mounting bracket.

* * * * *